United States Patent [19]

Grieve et al.

[11] 4,122,948

[45] Oct. 31, 1978

[54] CARTON INCORPORATING EASILY OPENABLE AND RECLOSABLE POURING APERTURE

[75] Inventors: Harold R. Grieve; Thomas S. Andersen, both of Battle Creek, Mich.

[73] Assignee: General Foods Corporation, White Plains, N.Y.

[21] Appl. No.: 817,307

[22] Filed: Jul. 20, 1977

[51] Int. Cl.[2] ..... B65D 5/54

[52] U.S. Cl. ..... 206/622; 206/628; 229/17 R

[58] Field of Search ..... 229/17 R; 206/622, 626, 206/621, 628; 229/7 R

[56] References Cited

U.S. PATENT DOCUMENTS

| | | | |
|---|---|---|---|
| 2,351,812 | 6/1944 | Guyer | 229/17 R |
| 2,436,981 | 3/1948 | Sullivan | 229/17 R |
| 2,933,230 | 4/1960 | Yezek | 229/17 R |
| 2,946,496 | 7/1960 | Stagmeier | 229/17 R |
| 3,426,955 | 2/1969 | Olson | 229/17 R |
| 3,498,522 | 3/1970 | Peet | 229/17 R |
| 3,640,446 | 2/1972 | Grieve | 229/17 R |
| 3,894,680 | 7/1975 | Araki | 206/622 |

*Primary Examiner*—Stephen P. Garbe

*Attorney, Agent, or Firm*—C. Garman Hubbard; Bruno P. Struzzi; Thomas V. Sullivan

[57] ABSTRACT

A carton is constituted of end wall and side wall panels, extensions on the panels forming top closure flaps and dust flaps, weakening lines being provided on the top closure flaps to define severable flap sections. One of the dust flaps is shaped in conformance with one of the top closure flap sections and is adhesively-bonded thereto, so that severing of the closure flap sections along the weakening lines will form a pouring aperture. The pouring aperture can be positively reclosed by tucking a free edge of the severable section of the outer top closure flap beneath a portion of the inner top closure flap.

11 Claims, 7 Drawing Figures

CARTON INCORPORATING EASILY OPENABLE AND RECLOSABLE POURING APERTURE

BACKGROUND OF THE INVENTION

The present invention relates to cartons which are designed for the packaging of contents comprising granular, powdery or other types of free-flowing products or bulk commodities and, more particularly, relates to a carton structure incorporating an easily openable pouring aperture or orifice adapted to be easily reclosed and to maintain the carton in a positive closed condition after initial opening thereof to thereby protect any product remaining in the carton from contamination or inadvertent spillage.

DISCUSSION OF THE PRIOR ART

Cartons which have hitherto been designed and constructed for similar packaging purposes and types of products, while incorporating an easy to open reclosable pouring aperture, have usually necessitated the use of excess amounts of board or carton stock in constructing the carton blank. Moreover, these cartons require complex scoring and weakening line patterns which render the cartons relatively expensive to manufacture, while reducing die cutting speeds in forming the blanks, and are consequently somewhat impractical from a commercial standpoint. Presently utilized cartons of the type under consideration also present registration problems in aligning the edges of their pouring apertures or closures incorporated therein with the adjacent or contiguous portions of the carton, particularly during the reclosing thereof. Upon occasion, this may prevent positive reclosure of the pour opening and lead to accidental spilling of the contents of the carton.

Thus, Grieve U.S. Pat. No. 3,640,446 discloses a carton with a tucked-in closure flap, in which a dispensing orifice is provided for through the intermediary of weakening or score lines extending across the closure flaps to provide readily end sections thereon which are severable therefrom and which are hinged to the carton wall or panel structure. In this instance, although the carton pouring aperture or closure flap is generally quite satisfactory in operation, precise registration and alignment is required for the severing lines of the inner and outer flap overlapping portions. Since only two opposite corners of a portion of the top closure flap tuck under upon reclosing of the carton, this will not afford a high degree of positive closing and may allow for accidental opening of the carton.

Yezek U.S. Pat. No. 2,933,230 discloses a carton providing for a pouring spout constructed through the provision of weakened or score lines on the carton top flaps, and including a foldable end flap member disposed beneath the side flaps. In this instance, in order to open the carton to form a pouring spout, and subsequently to reclose the pouring spout, the tucked portion of the end flap must be pulled outwardly into an unfolded position, and thereafter refolded prior to the closing of the side flaps. Although this structure incorporates a dust flap formed with a finger cut-out which is disposed in register with a finger cut-out in the tear-away or removable portion of the inner closure flap, these elements are not unitarily openable since they bend about different hinge lines which are at right angles to each other.

SUMMARY OF THE INVENTION

In order to obviate or ameliorate the limitations encountered in the prior art, the carton according to the present invention contemplates the provision of a carton structure which does not require the use of additional or excess board or other carton stock material, and which incorporates an easily openable and reclosable pouring aperture affording fool-proof opening and closing, with the reclosure being sufficiently tight to prevent accidental spillage of the contents of the carton. The foregoing is accomplished by providing tear or weakened lines across the inner top closure flap of the carton which will define a flap end section of predetermined area and configuration, to which the end flap of the carton disposed therebeneath is adhesively-bonded, being of an area and shape substantially in conformance with that of the end section. The overlying outer top closure flap, in turn, is provided with at least one weakened line which defines in part an end section thereof overlying the end section of the inner top closure flap. Upward pivoting of the end section of the outer closure flap by severing along the weakening line, and subsequent upward pivoting of the end section of the inner closure flap, and adhesively-bonded end flap, by severing along the weakening lines thereof will form the inventive pouring aperture. One of the weakening lines of the inner closure flap defines a lip on the latter beneath which a free edge of the end section on the outer closure flap is adapted to be tucked upon reclosure of the carton to thereby effectuate a positive closing action.

A particular aspect and feature of the present invention lies in that the carton may be of the linerless type, affording positive and tight reclosure of a fool-proof nature by the inventive pouring aperture. Moreover, the carton requires no excess carton stock for its opening construction, and is adapted to be produced from die cuts at high speeds. The simple structure of the carton blank also requires only a simple glue pattern to thereby allow for sealing of the carton at high speeds.

Accordingly, it is an object of the present invention to provide a carton incorporating a novel and unique pour opening construction.

Another object of the present invention is to provide for a carton of the type described which is readily reclosable and incorporates a positive spillproof closure for the contents therein without the need for excess carton stock.

BRIEF DESCRIPTION OF THE DRAWING

Reference may now be had to the following detailed description of preferred embodiments of the invention, taken in conjunction with the accompanying drawing, in which.

DETAILED DESCRIPTION OF THE INVENTION

Figure 1:
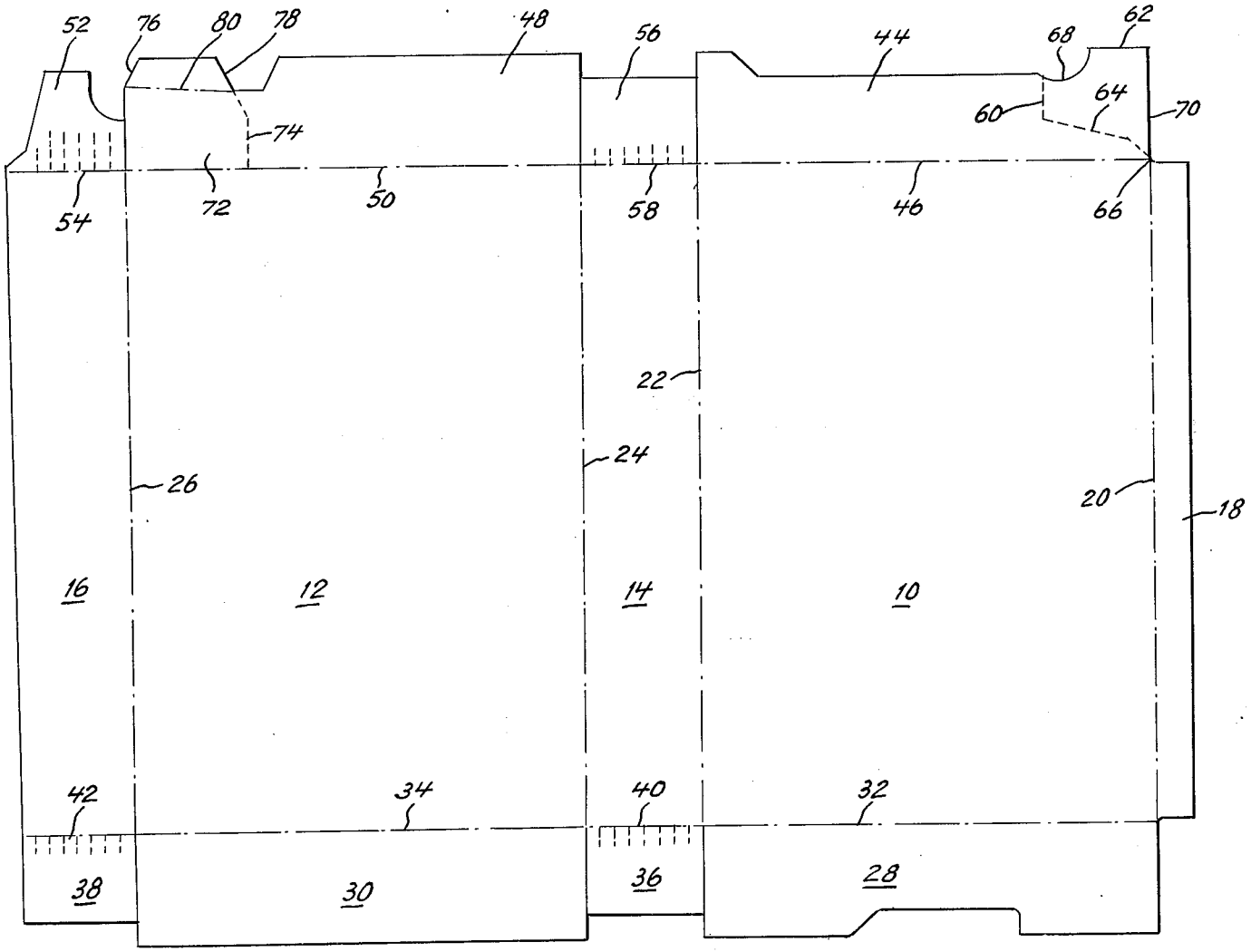
FIG. 1 shows a plan view of an individual carton blank as cut and scored for the construction of a carton providing an easily openable pouring aperture in accordance with the present invention.

Referring now in detail to the drawings, and particularly to FIG. 1, a carton pursuant to the present invention is constructed from a carton blank which has been cut from a web of cardboard, such as box board, paper board or other semi-rigid packaging material, in a manner well known in the art. The carton blank illustrated in FIG. 1 of the drawings is adapted for erection into a generally rectangularly cross-sectioned carton and discloses the surface of the blank designed to ultimately form the exterior surface of the finished carton. The carton blank is separated or divided by means of a pattern of score lines into a plurality of suitably arranged panels or walls and flaps. These carton blank panel and flap components include a back panel 10 which may be considered the rear wall of the resultant carton, and a face panel 12 adapted to provide the front wall of the carton. A first end panel 14 is located intermediate the face and back panels 12 and 10, and a further end panel 16 is joined to the front panel 12, whereas the rear panel 10 is joined to a glue flap 18 adapted to be adhesively bonded to the interior surface of end panel 16. The respective carton panels are separated by score lines 20, 22, 24 and 26.

The bottom of the carton may be constructed of conventional bottom closure flaps 28 and 30 which are extensions of, respectively, rear and front panels 10 and 12 and are separated therefrom by score lines 32 and 34. Similarly, bottom end or dust closure flaps 36 and 38 are formed by extensions of, respectively, end panels 14 and 16, and are separated therefrom by score lines 40 and 42.

The top of the carton, which incorporates the inventive easily openable reclosable structure, to be described in greater detail hereinbelow, comprises an extension of the panel 10 forming a first or inner top closure flap 44 which is separated from the panel 10 by score line 46; and a second or outer top closure flap 48 formed by an extension of panel 12 which is separated from the latter by score line 50. An end or dust flap 52 is constituted by an extension of the end panel 16 and is separated therefrom by score line 54, whereas an end or dust flap 56 is formed by an extension of end panel 14 and is separated therefrom by score line 58.

As illustrated in the drawing, score lines 32, 40, 34 and 42; and score lines 46, 50, 54 and 58 may each be constituted of a single or continuous straight score line.

The construction of the easily openable feature of the carton is derived in part by imparting to the inner top closure flap 44 a first weakening line 60, which may be constituted of a series of spaced or discontinuous slits or perforations of any suitable type and which are of sufficient depth and continuity to allow for ready severance therealong, with the line 60 extending in a straight line from the longitudinal free edge 62 of the flap 44 transversely across a portion of the flap towards but short of the score line 46. The weakening line 60 runs to a second weakening line 64 extending obliquely therefrom in a generally straight line, but preferably including a slight angle, to the corner 66 of flap 44 at score line 46. The flap 44 is also provided with an arcuate recess or cutout 68 having its curved edge running from the weakening line 60 to the flap free side edge 62.

The associated dust flap 52 is provided with a configuration generally coinciding with that of the above described end section of top closure flap 44, namely the section defined by weakening lines 60 and 64, notch 68, flap side edge 62 and flap end edge 70. Consequently, in the erected and sealed condition of the carton, the dust flap 52 underlies the end section of top closure flap 44 so as to be essentially in complete physical conformance therewith, and is adhesively-bonded to the flap 44 through the intermediary of a suitable glue or adhesive medium.

The outer top closure flap 48 is provided with an end section 72 through the interposition of a weakening line 74 formed in and extending transversely across the flap 48, and with the end section 72 overlying the end section on flap 44 and dust flap 52. The end section 72 is slightly longer than the end section of flap 44 whereby the line 74 is not in register with but is offset from the weakening line 60 on flap 44 in the closed or sealed condition of the carton for reasons hereinafter explained. The outer free edge of section 72 is provided with chamfers 76 and 78, the latter being formed by providing a notch in the longitudinal free edge of flap 48. Additionally, an obliquely extending score line 80 is provided on end section 72, which is in near alignment with the weakening line 64 on flap 44 in the closed condition of the carton, to thereby define the outer or free edge of end section 72 as a tab to be readily grasped by a consumer wishing to open the carton and to be tucked, leading corner first, under the inner closure flap 44 upon reclosing of the carton. The facing surfaces of superimposed top closure flaps 44 and 48 are inseparably adhesively-bonded, in a manner well known in the carton construction art, over areas located exteriorly of the end sections of the flaps. The construction of the carton, and that of the actual reclosure features, may be more closely ascertained from FIGS. 2 through 6 of the drawing.

Figure 2:
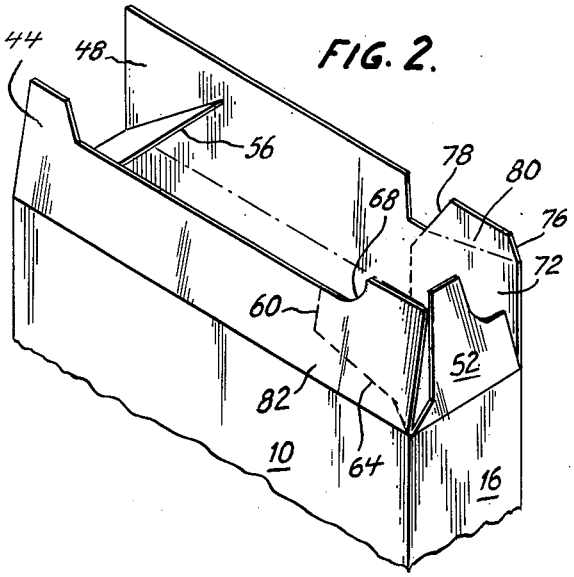
FIG. 2 is a perspective view of the upper portion of the carton with the closure flaps thereof illustrated in an opened condition.

FIG. 2 of the drawing illustrates the carton blank of FIG. 1 as having been bent along the various score lines thereof into an erected carton construction, prior to the closure flaps being folded into carton-sealing engagement. As shown in FIG. 2, the dust flaps 56 and 52 are in the process of being inwardly folded to thus underlie the inner and outer top closure flaps 44 and 48. Thereafter, the top closure flap 44 is closed to overlie the flaps 56 and 52, with the facing surfaces of the dust flaps and the top closure flap 44 being firmly adhesively-bonded together, in any manner known in the art. Thereafter, the outer top closure flap 48 is folded over the inner closure flap 44, with the contacting surfaces being adhesively-bonded or fastened together, exclusive of the area defined by the end section of the inner closure flap 44 and the end section 72 of outer closure flap 48 which are lightly or separably bonded together by techniques well known in the art. The closed and sealed carton construction may be clearly ascertained from FIG. 3 of the drawing.

Figure 4:
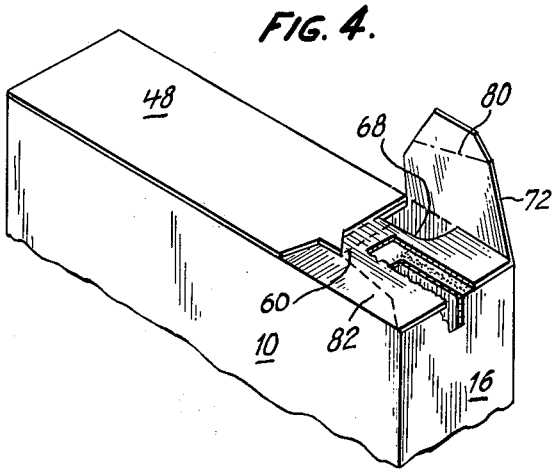
FIG. 4 illustrates the carton of FIG. 3, partly in section, with the pouring aperture in the initial stage of being opened.

When a purchaser of the carton or consumer desires to dispense some or all of the contents, preferably through the easily openable pour orifice construction to thereby allow for the reclosing of the carton, it is merely necessary to pull upwardly on the tab of end section 72 of the outer top closure flap 48, as illustrated in FIG. 4 of the drawing, so as to break the light adhesive bond thereat with flap 44 and sever the end section from the remainder of the outer flap 48 along tear line 74 and pivot it about score line 50. The ready grasping of the end section 72 is facilitated by bending the tab at the free unglued edge thereof upwardly along the score line 80.

Figure 5:
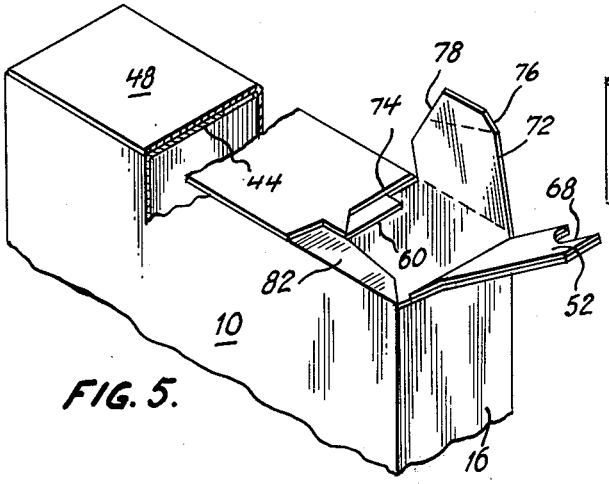
FIG. 5 illustrates the carton with the pouring aperture in a fully opened condition.
Figure 3:
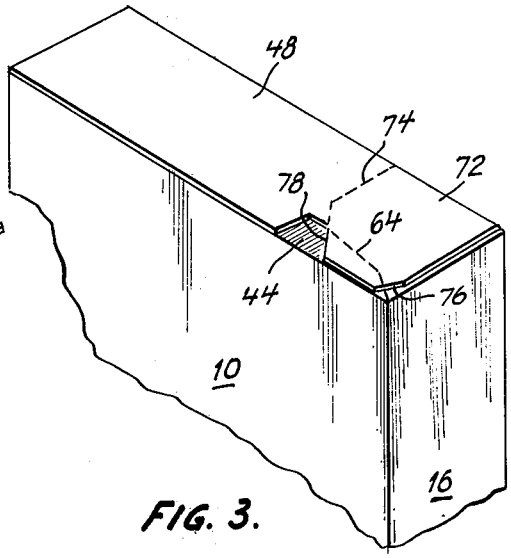
FIG. 3 shows a perspective view similar to that of FIG. 2 with the carton being in its fully sealed condition.

Thereafter, the adhesively-bonded dust flap 52 and end section of the inner top closure flap 44, as defined by the weakening lines 60 and 64, may be grasped by the consumer by way of inserting a fingertip into the carton through the recess 68 and pulling those sections of the carton upwardly and outwardly by severing along weakening lines 60 and 64, as shown in FIG. 5 of the drawing, and pivoting flap 52 about score line 54. This will then form a pouring orifice or dispensing aperture through which the contents of the carton may be readily dispensed.

Figure 6:
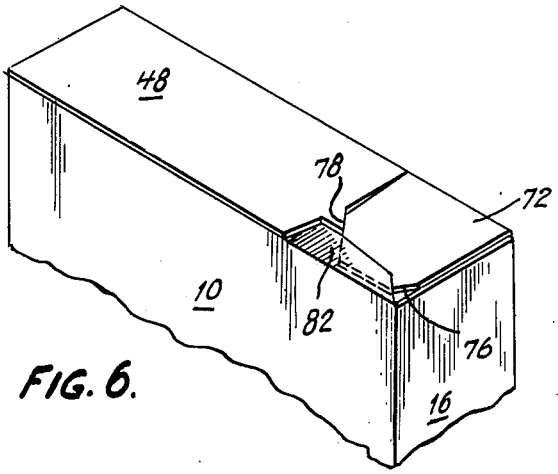
FIG. 6 illustrates the carton with the pouring aperture shown in a carton-reclosing condition.

Reclosing of the carton may be readily accomplished by folding the combined dust flap 52 and end section of flap 44 down horizontally into the carton and thereafter superimposing or overlaying the end section 72 of the outer top closure flap 48, as shown in FIG. 6 of the drawing. The end section 72 is held in a firmly closed position in that the severing of the end section of the inner closure flap 44 along weakening lines 60 and 64 forms a projecting edge or lip 82 on the inner closure flap 44, beneath which may be firmly tucked the free edge or lift tab of the end section 72 by bending down of the latter along score line 80 and slipping its free edge under the lip 82. The lip edge runs at a slight angle relative to the edge of the lift tab causing the corner of chamfer 78 to lead first under lip 82. This makes the tucking operation easier than if tucking the entire edge in at once were necessary. Weakening line 60 does not align with weakening line 74 in the closed carton. Line 60 thus defines a lip on flap 44 which holds end section 72 "up" during reclosure.

The carton may then be readily reopened for the dispensing of additional contents by merely grasping the end section 72 along one side edge or proximate its chamfers 76 and 78 and pulling upwardly to thereby disengage the free edge or lift tab thereof from the lip 82 on the inner top closure flap 44 beneath which it is tucked. The end sections may then be pivoted upwardly as described hereinbefore.

Figure 7:
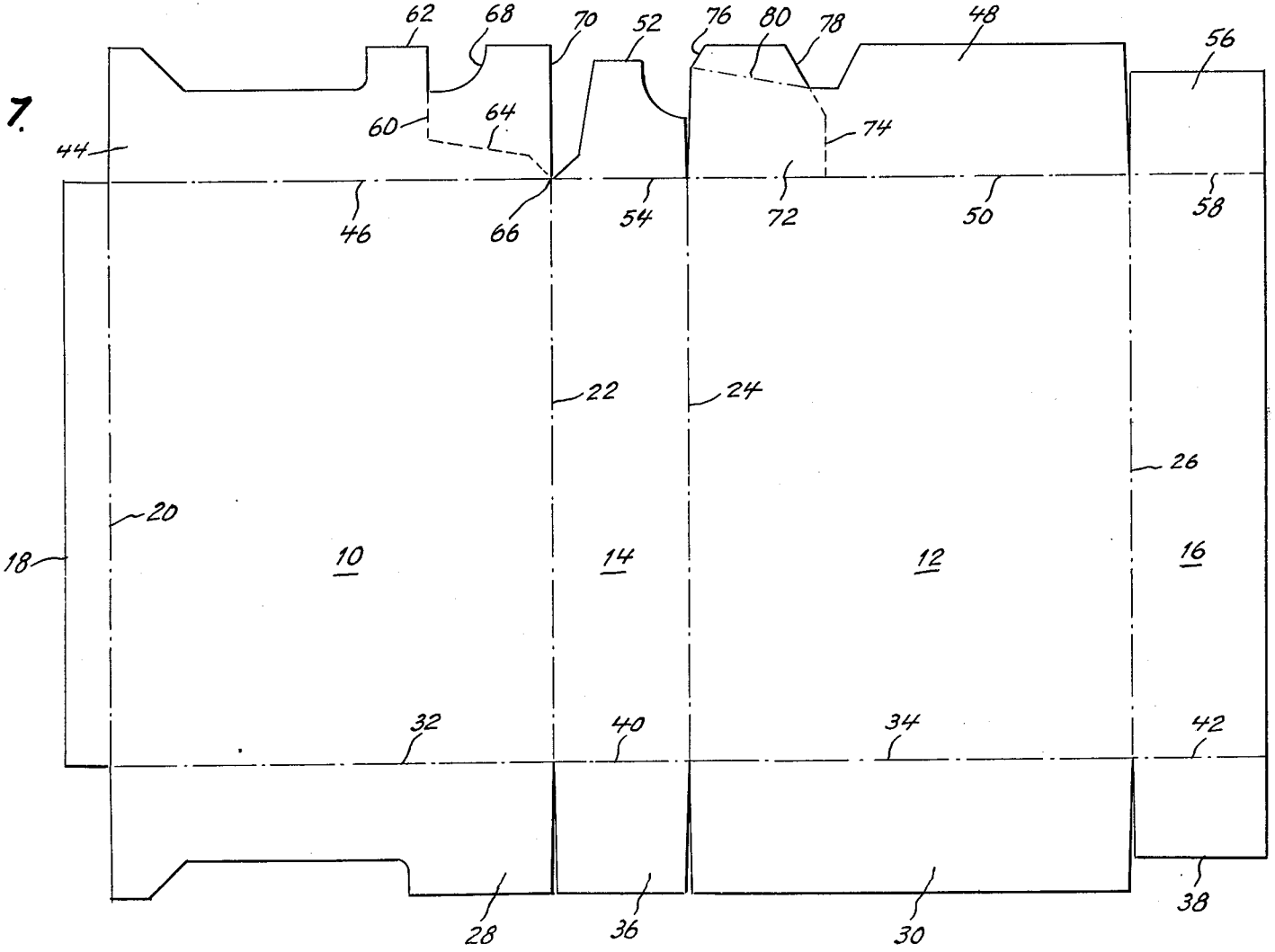
FIG. 7 illustrates a second embodiment of a carton blank for providing a carton pursuant to the present invention.

The carton blank structure shown in the embodiment of FIG. 7 of the drawings is quite similar to that shown in FIG. 1, and like reference numerals have been utilized throughout to identify similar or identical parts. However, in this embodiment the top portions of the carton blank forming the easy opening pouring aperature are located at the interior ends of the inner and outer top closure flaps 44 and 48, with the novel dust flap 52 constituting an extension of the end panel 14 instead of panel 16. The construction of the finished carton and operation of the novel pouring aperture is analogous to that of the embodiment of FIGS. 1 through 6 of the drawings, the primary distinctions being in the panel rearrangement of the carton blank per se.

From the foregoing, it becomes readily apparent that the invention provides a container structure incorporating a novel pouring aperture, which is adapted to be easily opened, and which affords improved reclosure of the carton to preserve and prevent spillage of any remaining contents therein.

What is claimed is:

1. A carton providing for a reclosable pouring aperture comprising side and end wall panels, pivoted extensions on said panels forming flaps for closing said carton, said closing flaps including outer and inner top closure flaps each extending from a respective side wall panel and dust flaps each extending from a respective end wall panel and underlying said closure flaps, the inner of said top closure flaps having weakening lines thereon running serially from one to another free edge thereof forming a severable end section in the corresponding end area of said flap, the dust flap underlying said end section being adhesively-bonded thereto and shaped in conformance therewith, the outer of said top closure flaps having a weakening line running from its pivoted edge transversely across the flap forming an end section thereon overlying the end section of said inner closure flap, the end section on said outer closure flap being severable along its weakening line for pivotal upward movement, the end section of said inner closure flap and dust flap adhesively-bonded thereto being severable along the weakening lines of the former for pivotal upward movement so as to form said pouring aperture, said aperture being reclosable by downward pivotal movement of said end sections and tucking of a free edge of the end section of said outer closure flap below an end area of said inner closure flap bordering its severable end section.

2. A carton as claimed in claim 1, including a finger-engageable recess formed in said inner closure flap end section and the dust flap adhesively-bonded thereto.

3. A carton as claimed in claim 1, including a lip portion formed on said inner closure flap along one weakening line thereof upon severing of the end section therefrom, a free edge of said end section of the outer closure flap being tuckable beneath said lip portion for effecting reclosing of said carton pouring aperture.

4. A carton as claimed in claim 1, the severable end section of said outer closure flap and said dust flap with the severable end section of said inner closure flap bonded thereto being hingedly joined to, respectively, a side wall and end wall panel of said carton for pivotal movement at substantially right angles to each other.

5. In a carton providing for a reclosable pouring spout for a generally free-flowing bulk commodity, said carton being formed of a semi-rigid material and having side and end wall panels, hinged extensions on said side wall panels forming inner and outer top closure flaps, and hinged extensions on said end wall panels forming dust flaps, the improvement wherein said inner closure flap includes an end section defined by a first weakening line extending across a portion of said flap from a free edge and in a direction normal to the hinge line thereof and joining a second weakening line running obliquely thereto and terminating at the juncture between said flap, the adjoining end wall panel and the dust flap extension on the latter, said extension being shaped to generally conform with the configuration of said end section on said inner top closure flap, said extension underlying said end section and being adhesively-bonded thereto; said outer closure flap including an end section defined by a weakening line extending across said flap in a direction normal to its hinge line, the end section of said outer closure flap overlying said extension and the end section of said inner closure flap and being separably adhered thereto in a sealed condition of said carton, the first weakening line on said inner closure flap and the weakening line on said outer closure flap being in a slightly offset relationship to render the latter end section longer than the former; whereby said carton is adapted to be opened to form said pouring aperture by pulling up said end section on said outer closure flap and severing the weakening line thereon and subsequently pulling up the end section of said inner closure flap and severing the weakening lines of the latter, said carton being reclosable by pushing down the end section of said inner closure flap, overlaying the end section of said outer closure flap and inserting a free edge on said last-mentioned end section beneath the inner closure flap, the end section of the outer closure flap being supported along a marginal edge thereof by a portion of the inner closure flap bounding its end section when the carton is reclosed.

6. The carton structure as claimed in claim 5, including an edge recess formed in said dust flap extension and the end section of said inner closure flap adapted to facilitate finger-engagement thereof for severing same along its said weakening lines.

7. The carton structure as claimed in claim 5, wherein a lip is formed on said inner closure flap resulting from the end section thereof being severed along said second weakening line, the free edge of the end section of said outer closure flap opposite its hinge line being tuckable beneath said lip with a corner thereof leading upon reclosing of said carton.

8. The carton structure as claimed in claim 7, wherein said free edge defines a tab portion of the outer closure flap end section which is also defined by a bend line therein substantially aligning with the edge of said lip on said inner closure flap to facilitate the tucking of said free edge beneath said lip during carton reclosure.

9. The carton structure as claimed in claim 5, said inner and outer closure flaps being inseparably adhered together at their interfaces exteriorly of the severable end sections thereof.

10. The carton structure as claimed in claim 5 erected from a carton blank wherein the end wall panel having the dust flap extension conforming with the end section of said inner closure flap is disposed at one end of said blank.

11. The carton structure as claimed in claim 5 erected from a carton blank wherein the end wall panel having the dust flap extension conforming with the end section of said inner closure flap is disposed between the side wall panels of said blank.

* * * * *